US007878329B1

(12) United States Patent
McCarron et al.

(10) Patent No.: US 7,878,329 B1
(45) Date of Patent: Feb. 1, 2011

(54) SHIPPING BOX SYSTEM

(75) Inventors: Phil McCarron, Paisley (GB); Joanne Kennedy, Halifax (GB)

(73) Assignee: Acorn Mobility Services Ltd., West Yorkshire (GB)

( * ) Notice: Subject to any disclaimer, the term of this patent is extended or adjusted under 35 U.S.C. 154(b) by 657 days.

(21) Appl. No.: 11/548,941

(22) Filed: Oct. 12, 2006

(51) Int. Cl.
*B65D 81/02* (2006.01)

(52) U.S. Cl. ..... 206/521; 206/592

(58) Field of Classification Search ..... 206/521, 206/583, 591–594, 448, 386; 220/1.5, 4.28
See application file for complete search history.

(56) References Cited

U.S. PATENT DOCUMENTS 3,718,275 A * 2/1973 Willinger ..... 206/521
3,985,231 A * 10/1976 Farhat et al. ..... 206/448
5,110,037 A * 5/1992 Pieritz, Sr. ..... 206/386
5,269,422 A * 12/1993 Chevrette ..... 206/448
5,655,662 A * 8/1997 Garcia ..... 206/583
6,268,039 B1 * 7/2001 Chou et al. ..... 206/583
6,679,378 B1 * 1/2004 Vermeulen et al. ..... 206/335
2002/0104776 A1 * 8/2002 Foster ..... 206/521

* cited by examiner

*Primary Examiner*—Luan K Bui
(74) *Attorney, Agent, or Firm*—Fish & Richardson P.C.

(57) ABSTRACT

A shipping box system includes a plurality of walls defining a volume substantially in the form of a cuboid, a rigid base near a first wall of the plurality of walls adapted to resist motion relative to the first wall, and a rigid mount attached to the rigid base and adapted to connect with a shipped item to be placed in the volume, wherein the plurality of walls are configured to create a free space around the shipped item so as to prevent damaging contact with a substantial portion of the shipped item.

15 Claims, 7 Drawing Sheets

SHIPPING BOX SYSTEM

TECHNICAL FIELD

This invention relates to shipping boxes, such as corrugated paper boxes, and related components.

BACKGROUND

With corporate factories scattered across the globe, and with customers also scattered across the globe, shipping of products has become a central part of making global business work. Hundreds of shipping companies provide for transit of various packages of all weights and sizes, generally in corrugated boxes known popularly as "cardboard boxes."

The expense of conducting far flung business can increase greatly, however, if products are damaged in transit. Shippers are not always concerned with proper handling of shipped goods, and mechanical handling equipment has even less concern. As a result, packages may get jostled, dropped, hit, poked, and tossed. The sudden deceleration from a moving or flying package hitting a solid object, like the floor, causes many products to break before they even reach a customer. As a result, the products may need to be returned and then fixed or replaced. This involves both shipping a new (or repaired) product, and repackaging and shipping the broken product. Additional costs may attend to such replacement or repair, as companies must track additional products, and must dispose of material from defective products. All of this can be very expensive.

Thus, it can be important to package products so that they will not be damaged in transit. Various cushioning materials have been used in shipping boxes, such as so-called "bubble wrap" and "foam peanuts." These materials are generally placed or wrapped around a product so as to interfere with any sudden jolts to the box in which the goods are placed. Equipment (e.g., personal computers) is also frequently held in place by foam blocks that wrap all around the equipment or hold the equipment on the edges or corners, and also keep the equipment spaced away from the edges of the box.

It can also be important to enable products to be easily removed from their packaging for ultimate use by a customer. Packaging designed to protect a product during shipping may create challenges for consumers trying to unpack the product. For example, Styrofoam blocks that do a good job of holding equipment in place may have to engage the walls of a shipping box tightly to provide such protection. But that tight interference may make it difficult to separate the equipment from the box.

SUMMARY

This document describes shipping box systems that may provide effective protection for objects in a shipping box, such as a cardboard box. In one implementation, the systems may do so by providing one or more solid mounting structures for the object that positions the object in open space inside the box, so that the other parts of the object do not press against anything other than air or other structures with very high degree of "give." In some implementations, the systems may be particularly suited for shipping objects that have very strong sections that do not break easily, and other areas that are not as strong and need protection. One example, is drive units for stairlifts or chairlifts for the disabled, which, of necessity, have strong bases where they mount to rails and also strong posts for carrying seats that holding people using the stairlifts. The other portions of the stairlift, such as any decorative housing around the motor and other components of the stairlift, may be more easily damaged, and thus may be held away from such damage using the techniques described herein. This document generally uses the terms stairlift, chairlift, and stairway chairlift interchangeably.

In one aspect, a shipping box system is disclosed. The system comprises a plurality of walls defining a volume substantially in the form of a cuboid, a rigid base near a first wall of the plurality of walls adapted to resist motion relative to the first wall, and a rigid mount attached to the rigid base and adapted to connect with a shipped item to be placed in the volume, wherein the plurality of walls are configured to create a free space around the shipped item so as to prevent damaging contact with a substantial portion of the shipped item. The plurality of walls may be formed from a single sheet of folded corrugated board. The rigid base may comprise one or more mounting blocks positioned near opposed edges of the first wall. Also, the rigid mount may comprise one or more rails attached to the one or more mounting blocks, and the rigid mount may comprise a pair of pipes mounted between a pair of mounting blocks, which may in turn comprise a plurality of sheets of corrugated board adhered in stacks having multiple layers with opposed lines of corrugation.

In some aspects, the system may further comprise a mounting block near a wall other than the first wall for engaging a component of the shipped object. The system may also comprise reinforcing panels at opposed walls of the volume that provide torsional rigidity to prevent distortion of the volume. The reinforcing panels may comprise a plurality of sheets of corrugated board adhered in stacks having multiple layers with opposed lines of corrugation. Also, the rigid base may include one or more mounting blocks positioned near opposed edges of the first wall.

In other aspects, the system may further comprise a substantially closed enclosure inside the volume and around the item to be placed in the volume. The system can also include one or more removable panels between the plurality of walls and a structure holding the item, wherein removal of the panels results in reduced friction between the plurality of walls and the structure, thereby permitting easier removal of the structure and the item from the volume.

In another implementation, a method of protecting an item having a rigid portion and more fragile portions is disclosed. The method comprises attaching a rigid portion of the item to a mount, rigidly securing the mount and the item in an outer enclosure, wherein portions of the item away from the mount are held in open space in the enclosure, and placing one or more panels in the enclosure to provide torsional rigidity to prevent the enclosure from hitting the item during shipping. The step of rigidly securing the mount and the item can include providing the mount on a rigid base secured near opposed ends of the shipping enclosure. Also, the rigid mount may comprise one or more rails attached to the one or more mounting blocks. The rigid base may connect to a plurality of reinforcing panels defining edges along at least three edges of a side of the enclosure so as to resist distortion of the side of the enclosure. Moreover, the reinforcing panels may be comprised of a plurality of sheets of corrugated board adhered in stacks having multiple layers with opposed lines of corrugation.

In some aspects, the method may further comprise placing the mount and item inside an inner enclosure and placing the inner enclosure inside the outer enclosure. The method may additional include placing slide-out structures between the inner enclosure and the outer enclosure to keep the inner enclosure in place during shipping, but permit removal of the inner enclosure after the slide-out structures are removed.

In yet another implementation, a shipping box system is disclosed. The system includes an outer enclosure in the form of a shipping box, and defining a plurality of inner walls, an inner enclosure for holding an item to be shipped, and having a plurality of surfaces parallel with, and spaced slightly apart from, the plurality of inner walls of the shipping box, and one or more slide-out panels held between the plurality of surfaces on the inner enclosure and the plurality of inner walls on the shipping box. The outer enclosure can define a cuboid, and the inner enclosure can also define a cuboid.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1A:
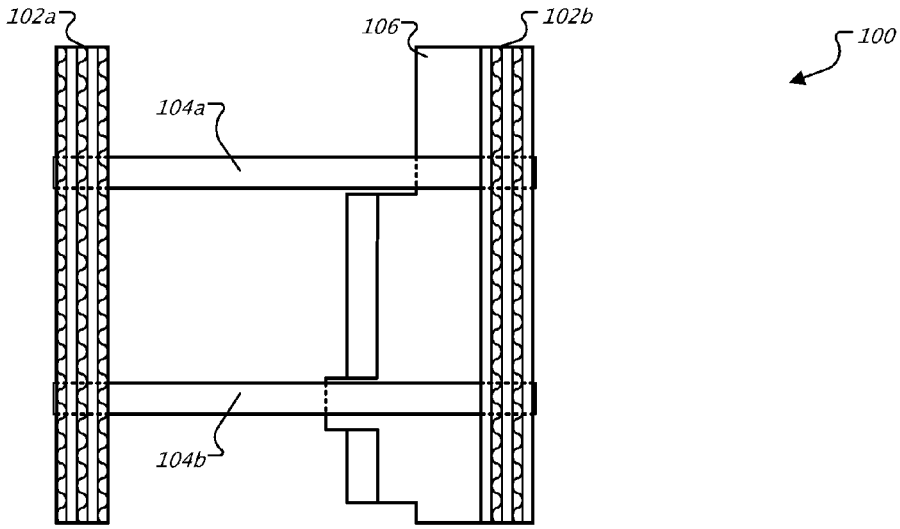
FIGS. 1A-1C shows three views of an exemplary mounting structure for use in a shipping box.
Figure 1B:
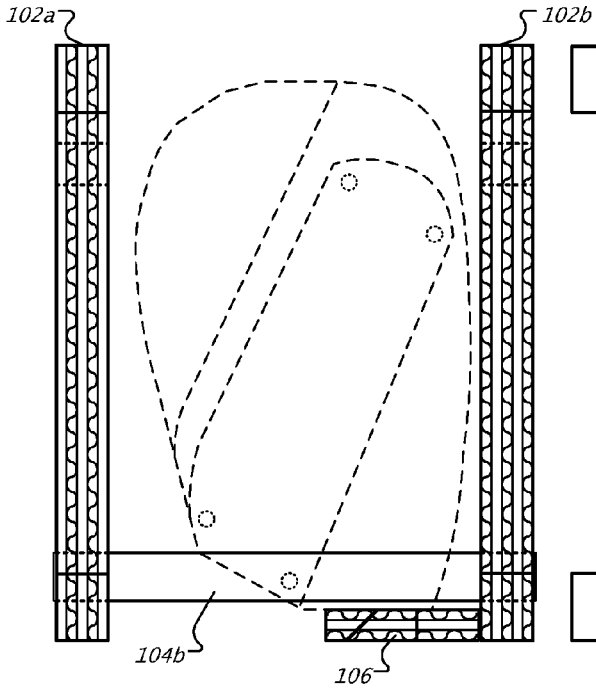
Figure 1C:
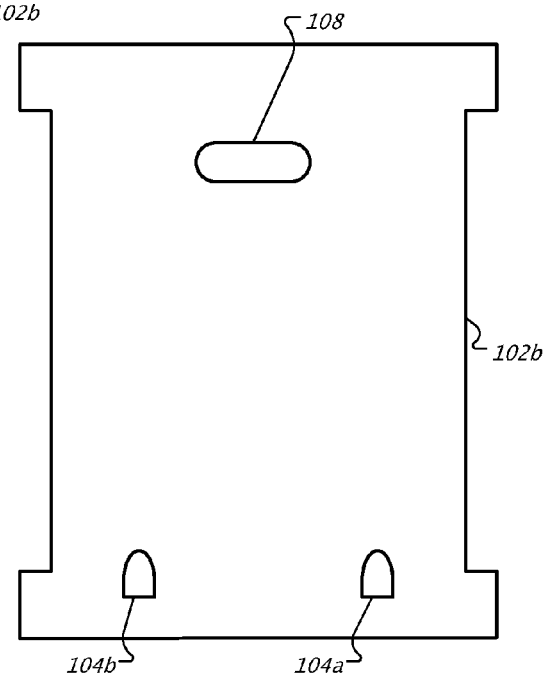

FIG. 1*a* shows a top view, FIG. 1B shows a side view, and FIG. 1C shows an end view of an exemplary mounting structure for use in a shipping box. The structure is shown in the form of a frame 100 that may be employed to solidly hold a variety of objects inside a shipping box. In general, frame 100 is adapted to hold and protect objects that have a solid portion, and also have a less solid and more easily damaged portion. In the exemplary embodiment of FIGS. 1A-C, frame 100 is shown holding a drive unit for a stairlift—a motorized unit on which a seat may be placed to carry a disabled person up and down stairs in their home. Such a device is well-suited for use with frame 100 because the stairlift has a solid portion where it attaches to rails that carry it up and down stairs, and also has a more easily damaged portion, in that its housing may be cracked or dented if subjected to strong force. Thus, frame 100 provides solid connections at the base of the object, but holds the more easily damaged parts of the object in open space.

As shown, frame 100 is comprised of a pair of mounting panels 102*a*, 102*b*, and a pair of rails 104*a*, 104*b*. The mounting panels 102*a*, 102*b* may be generally planar and rigid objects spaced apart from each other on opposed sides of the object be protected, so as to create an open space for the object to be protected. The panels 102*a*, 102*b* may be provided with handles, such as handle 108, so as to provide for easy manipulation of the frame 100 by a user. In addition, the panels 102*a*, 102*b* need not be solid across a majority of their surfaces. For example, a plastic panel could be formed as a frame, with linear pieces of the frame arrayed around the perimeter of the panel (like beams in a bridge) and mostly empty space between.

The panels 102*a*, 102*b* may be constructed from various materials, and as shown, panels 102*a*, 102*b* include a plurality of sheets of corrugated board, such as paperboard or cardboard. Each sheet may be glued or otherwise adhered or connected to the next sheet so as to produce a panel of sufficient thickness and rigidity to provide protection for the object placed between the panels 102*a*, 102*b*. In particular, panels 102*a*, 102*b* may provide torsional rigidity to a shipping box system in which the frame 100 is placed so as to prevent the box from twisting, and to prevent the walls of the box from striking or pushing against the more fragile portions of the object carried in the box.

Where the panels are made from corrugated board, the direction of the corrugation may be at a right angle for each successive panel so that the corrugation is first running vertically, and then horizontally, and then vertically. The relative directions of the corrugation may take on different angles also. Such alternative direction of the corrugation may provide additional strength and rigidity to the panels, much like the variation in grain for plywood sheathing.

In appropriate circumstances, other materials may also be used. Injection molded plastic may make up all or part of the panels, for example. Also, certain forms of styrofoam may be useful, or wood such as sheets of plywood may be used.

The lower portions of the panels 102*a*, 102*b* may each serve as a block to support rails 104*a*, 104*b*, which span from panel 102*a* to panel 102*b*. As shown, the rails 104*a*, 104*b* extend through holes in the panels 102*a*, 102*b* and are held tightly in those holes, by friction and/or by the fact that the various pieces are held in position inside a shipping box so that the rails will not slide easily. Other mechanisms may also be used to hold the rails in place relative to the panels 102*a*, 102*b*, such as by driving a pin through the panels 102*a*, 102*b* and through the side of a rail to prevent it from sliding. The support may also be provided separately from panels 102*a*, 102*b*, such as in the form of a block (e.g., of paperboard or wood) placed inside the panels, or may otherwise be arranged to hold an object inside a shipping box.

Rails 104*a*, 104*b* are shown in the figure to match the form of a mounting structure adapted to the object to be carried. In the exemplary embodiment, they take the form of rails that may match the rails to which a stairlift drive unit would be attached during it operations. Alternatively, the mounts could take any form that is appropriate to the particular circumstances. For example, the mount could be a ball or multiple balls designed to fit in sockets on an item to be carried. Alternatively, the mount may be one or more sockets, journals, or other structures corresponding to extensions on an item to be carried. Other appropriate arrangements are also possible.

Support block 106 is also shown below the object to be carried, and may provide additional support to prevent motion of the object during shipping. Support block 106 may be, for example, a wood block or a block of corrugated board placed under the object or under the mount. Alternatively, support block 106 may be attached to other components of the system described in FIGS. 2*a* and 2*b*.

Figure 2A:
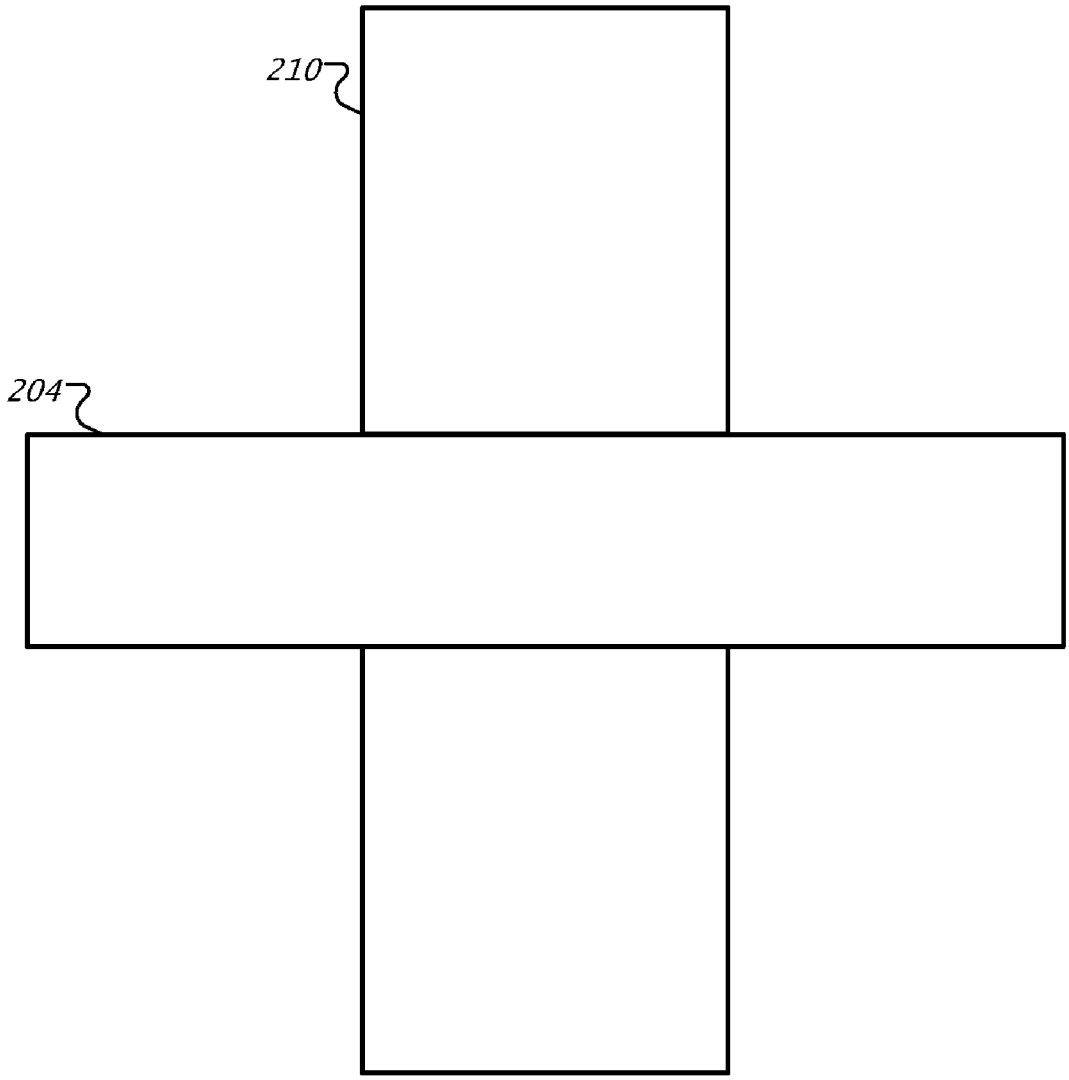
FIGS. 2A-2E show views of exemplary insert structures for use in a shipping box.
Figure 2B:
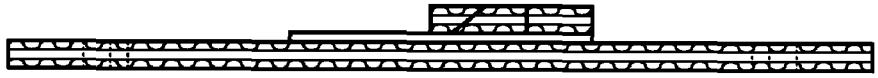
Figure 2C:
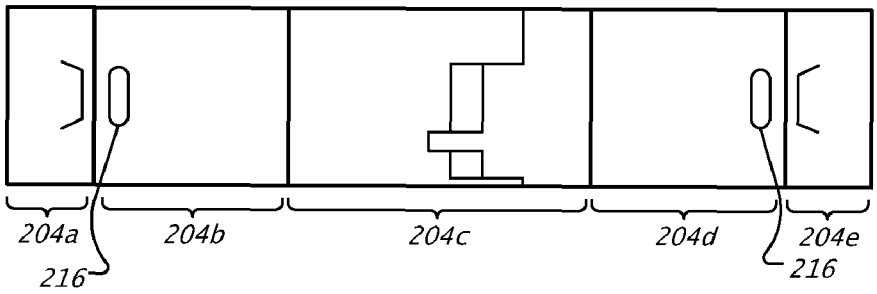
Figure 2D:
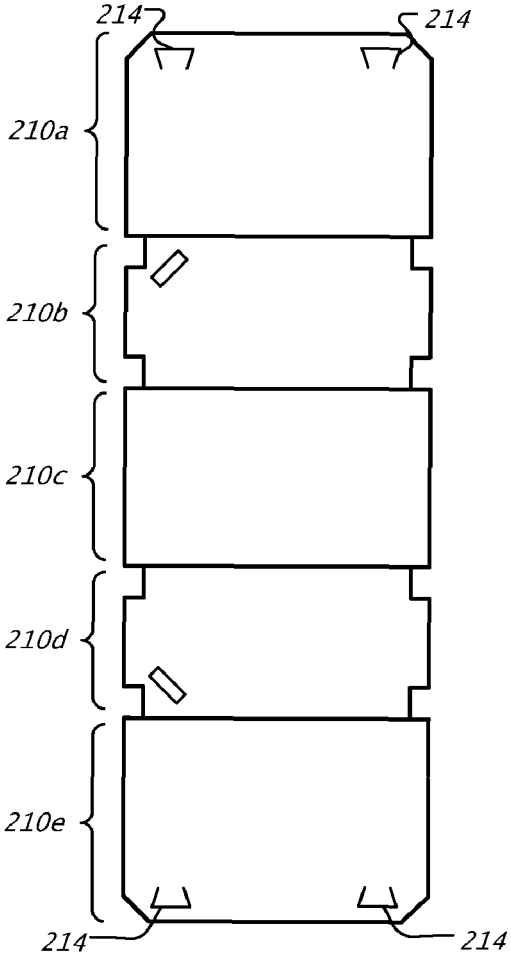
Figure 2E:
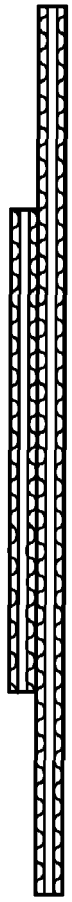

FIGS. 2A-2E show views of exemplary insert structures for use in a shipping box. FIG. 2A shows two crossed structures, while FIGS. 2B and 2D show side and top views, respectively of one of the crossed structures, and FIGS. 2D and 2E show top and side views, respectively, of the other of the crossed structures. In this exemplary embodiment, the structures are made of sheets, such as sheets of corrugated board. When folded, the sheets may produce an enclosure for a structure such as folded frame 100 shown in FIGS. 1A-C. The enclosure may in turn be inserted into a shipping box, along with other components, to produce a complete shipping box system. Upon receipt of all the components, a user may open the box, remove the enclosure, and unpack the remaining components to get access to the object inside.

The structures for the enclosure, shown in FIGS. 2A-2E include a horizontal sheet 204, and a vertical sheet 210, shown in top view in FIG. 2A. In general, the horizontal sheet 204 would be placed on top of the vertical sheet 210 on a flat surface such as a floor. Frame 100 from FIGS. 1A-C would then be placed in the central, overlapping region of the sheets 204, 210. The sheets 204, 210 would then be folded around the frame 100 to produce an enclosure. The sheets 204, 210 may be scored or scribed as needed to allow the folds to occur in the proper locations.

FIGS. 2B-2E show each sheet in more detail, with both a top view and a side view for each. In general, the sheets are made up of one or more pieces of corrugated board. In addition, items may be attached to the board in particular places to serve particular functions. Also, portions of the board may be removed, or additional layers of board may be provided, such as to provide additional strengths to the sheets. Referring now to particular portions of sheets 204, 210, there is first provided in the center of horizontal sheet 204, a base portion 204*c*. The base portion 204*c* may sit, during transit, at the bottom of a shipping box to provide a base for other items in a system. On each side of base portion 204*c*. there is a wall portion 204*b*, 204*d*, which may initially sit flat on each side of base portion 204*c*, but may then be bent upward, such as at a right angle, to form walls for an enclosure around an object to be shipped. Horizontal sheet 204 may be scribed along its bottom surface at the bending points to permit greater flexibility in the sheet 204. At the ends of horizontal sheet 204 are top flaps 204*a*, 204*e*, which may be adapted to fold at a score mark over the top of an object to be protected.

Vertical sheet 210 has similar portions. For example, base portion 210*c* may be positioned below an object to be protected, and side portions 210*b*, 210*d* may be adapted to fold upward at right angles on the side of an object. Finally, top portions 210*a*, 210*e* may fold over the top of an object to complete an enclosure around the object. Therefore, horizontal sheet 204 may be fully folded to provide sidewalls and a top for an object, while vertical sheet 210 may be folded to provide end walls and a top for the object.

Additional features may be provided with sheets 204, 210 to provide for extra functionality. For example, handles 216 may be cut in the panels to provide for hand holds. The handles may make it easier to manipulate the object while it is inside the enclosure. In addition, flaps 214 may be provided in the top portions 210*a*, 210*e* so that a user may push the flaps 214 against each other. This may lock the opposed top portions together, so that the enclosure stays closed naturally.

In addition, cutouts 212 are provided in sidewalls of the enclosure to hold an additional block (not shown) that may engage an upper part of the object to be protected. For example, where the object is a chairlift unit and has an upwardly extending post to carry a seat for the chairlift, a corrugated board block may be provided with a hole in it to slide over the post, and may have tabs or wings that extend outwardly to be held in place by the cutouts 212. Such a block may provide additional support and rigidity for the object to be protected, thereby preventing additional motion at the top end of the object in addition to the bottom end.

Figure 3:
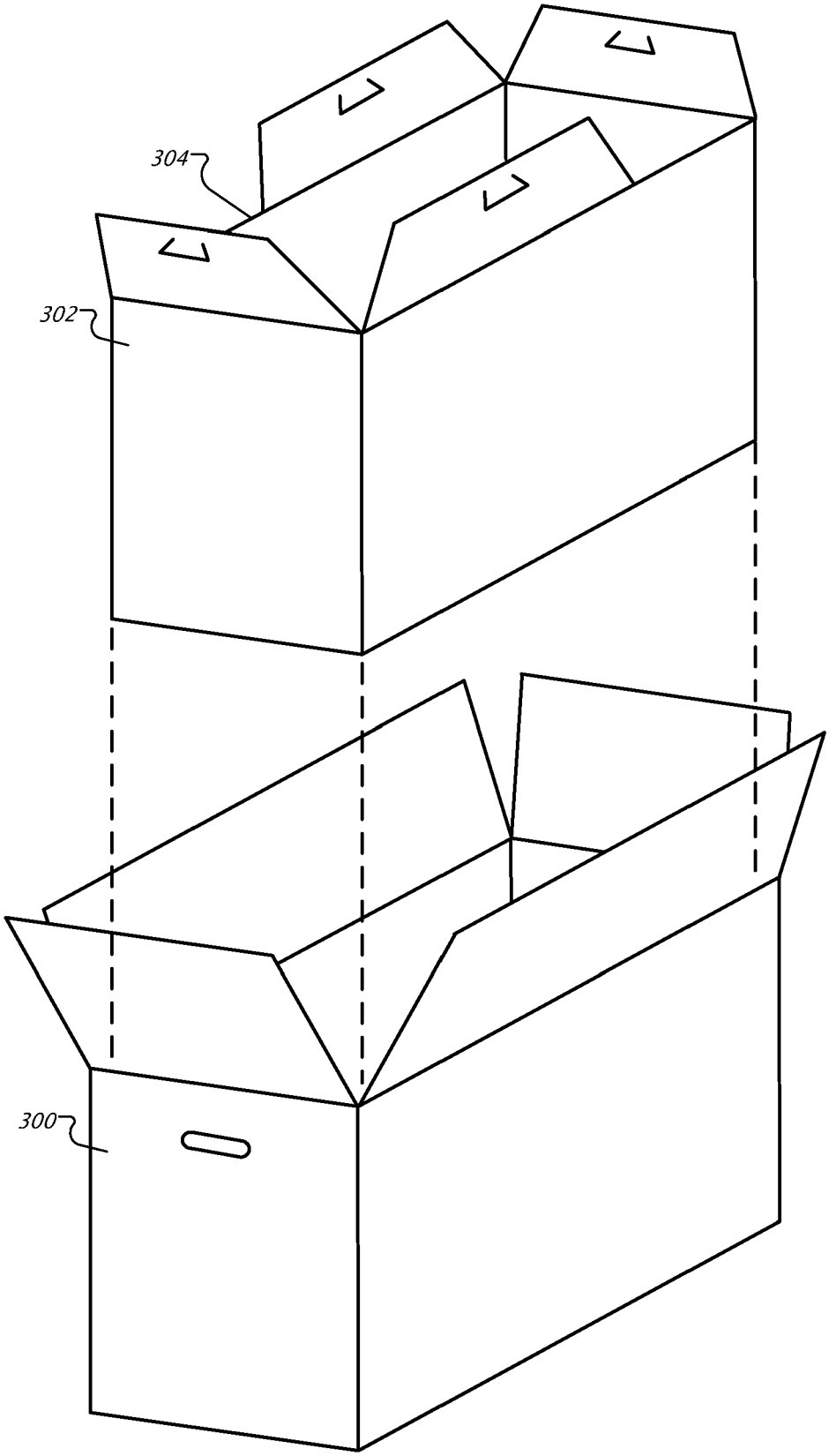
FIG. 3 is a perspective view of a shipping box having slide-out panels.

FIG. 3 is a perspective view of a shipping box 300 having slide-out panels 302, 304. The box 300 may be a standard corrugated panel box having sufficient strength for overland shipping. The slide out panels 302, 304 may take the form of a pair of flat corrugated boards that may be sized to fit against the inner walls of box 300, and also to fit outside of an inner structure such as an enclosure produced by panels 204, 210 in FIGS. 2*a*-2*b*.

The box 300 may generally take a cuboid form, i.e., a three-dimensional rectangle. As such, the walls may be of uneven length, so that all six sides are rectangles, two sides are squares, four sides are squares, or all sides are squares (a true cube).

In this exemplary embodiment, panels 302, 304 are corrugated board sheets that each have been folded so as to cover two sides on a rectangular space, each in an L-shape. Various other arrangements may also be employed. For example, four single-side panels may be used, with each panel inserted separately. Or one four-sided panel may also be used. Alternatively, panels may be provided on fewer than all sides of a box, such as only on two opposed sides, or only on two adjacent sides.

In addition, panels 302, 304 may be provided with additional features. For example, panels 302, 304 may be scalloped or scored on one side to make it more difficult for the panel to slide on that side (and, by comparison, easier to slide on the other). In addition, the panels 302, 304 may be coated on one or more sides with a friction-reducing layer.

The panels 302, 304 are also shown with handles formed into their upper portions, so as to allow the panels 302, 304 to be removed from the box 300 before an enclosure inside the box 300 is removed, as will be described in more detail below. The handles may be conveniently formed from a portion of the panels 302, 304 that extend above the sidewalls of the box 300. In such an embodiment, the handles can be formed inexpensively simply by providing an extension on the panels and stamping a handle hole in them. Where the handles are formed from such extensions, their edges can be tapered as shown so that they do not overlap with each other when they are folded over the top of the object to be protected. In this way, the top of the handle structures can be uniform in height when folded because they do not overlap.

In position, an enclosure holding an object to be protected may be sized to fit relatively loosely inside box 300, and panels 302, 304 may then be slid between the enclosure and the box to produce a tight fit. The tight fit may prevent the object and its enclosure from moving inside box 300 during shipping. By limiting such motion, the object inside the enclosure may be better protected from damage.

Such a tight fit between the components may normally produce frustration for recipients of the object, because the friction between the components will prevent the object from sliding easily out of the box 300. In particular, if a user tries to lift the object out of the box, the box (which is relatively lightweight) will lift with the object, so that two people may be required to pull the box off the bottom of the assembly. This process is often difficult because the object inside the box may be very heavy, and difficult for one person lift out of the box and then tip backward in a way that the second person can pull it out on the box.

However, panels 302, 304 may be pulled out relatively easily because the weight of the object inside the box will hold everything but the panels down. The enclosure will not come up because it is being held down by the object inside, and the box will not come up because the enclosure will be resting on the bottom of the box. With the panels removed, in contrast, the friction will be much less, and the object (which may be inside an enclosure like that discussed above) may be lifted out more easily, as shown in more technical detail next.

Figure 4:
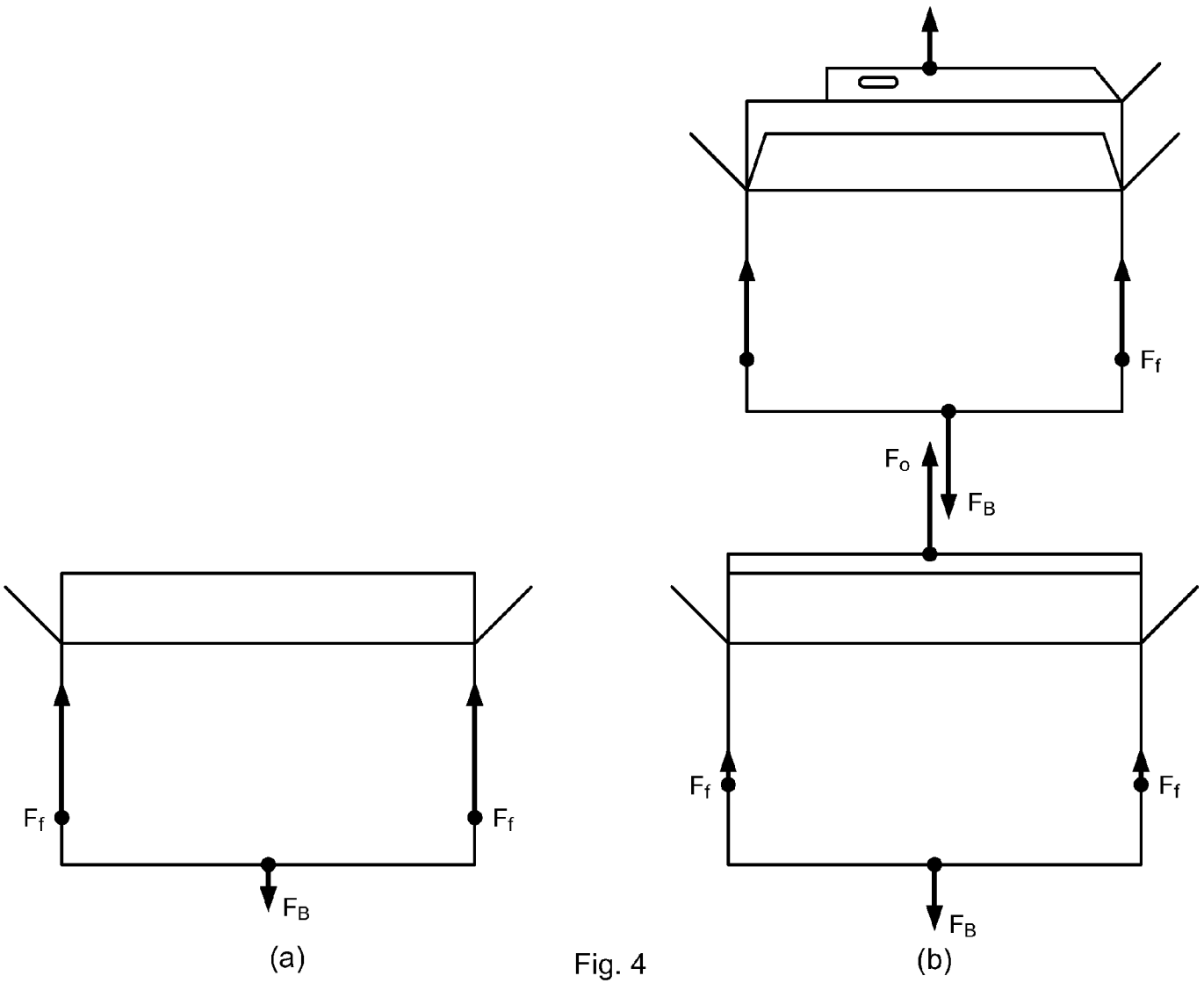
FIGS. 4*a*-4*b* show free body diagrams to illustrate possible benefits from the use of removable panels in a shipping box system.

FIGS. 4*a*-4*b* show free body diagrams to illustrate possible benefits from the use of removable panels in a shipping box system. FIG. 4*a* shows forces when an object is fit tightly inside a box, and an attempt is made to lift the object out. The box itself is not very heavy, as indicated by a small downward vector $F_B$. However, the friction forces upward on the box are much larger as indicated by the relatively large upward vectors $F_f$. These friction forces are directed upward because the enclosure or object inside the box that is applying the forces to the box, is itself being lifted with great force by a user. As a result, the box is pulled upward, and the recipient of the package is frustrated.

In FIG. 4*b*, the panels 302, 304 are being removed in the top figure. Although the friction force from the panels 302, 304 pulling up on the box 300 is just as high as it was in the first figure, the box is being held down by the force of the item in the box, so that vector $F_B$ is shown to be large, and to exceed the friction force. As a result, the friction force upward is not enough to lift the box 300 or the object inside, and the panels 302, 304 slip out.

In the lower image of FIG. 2*b*, the panels 302, 304 have been removed from the box 300, and force is being applied upward to the object or enclosure inside the box. In other words, someone is trying to lift the object or enclosure out of the box 300. Here, the lifting force on the object is relatively high (essentially equal to the weight of the object), as shown by vector arrow $F_O$. However, the frictional force upward (shown by $F_f$) on the box is minimal because the space between the inner wall of the box 300 and the outside portion of the object or the enclosure around the object prevents much friction force (e.g., normal force between the walls) from being generated, and thus keeps the friction force vector small. As a result, even the minimal weight of the box downward ($F_B$) exceeds the frictional force upward, the box stays on the ground, and a single user can easily disassemble the entire system.

Figure 5:
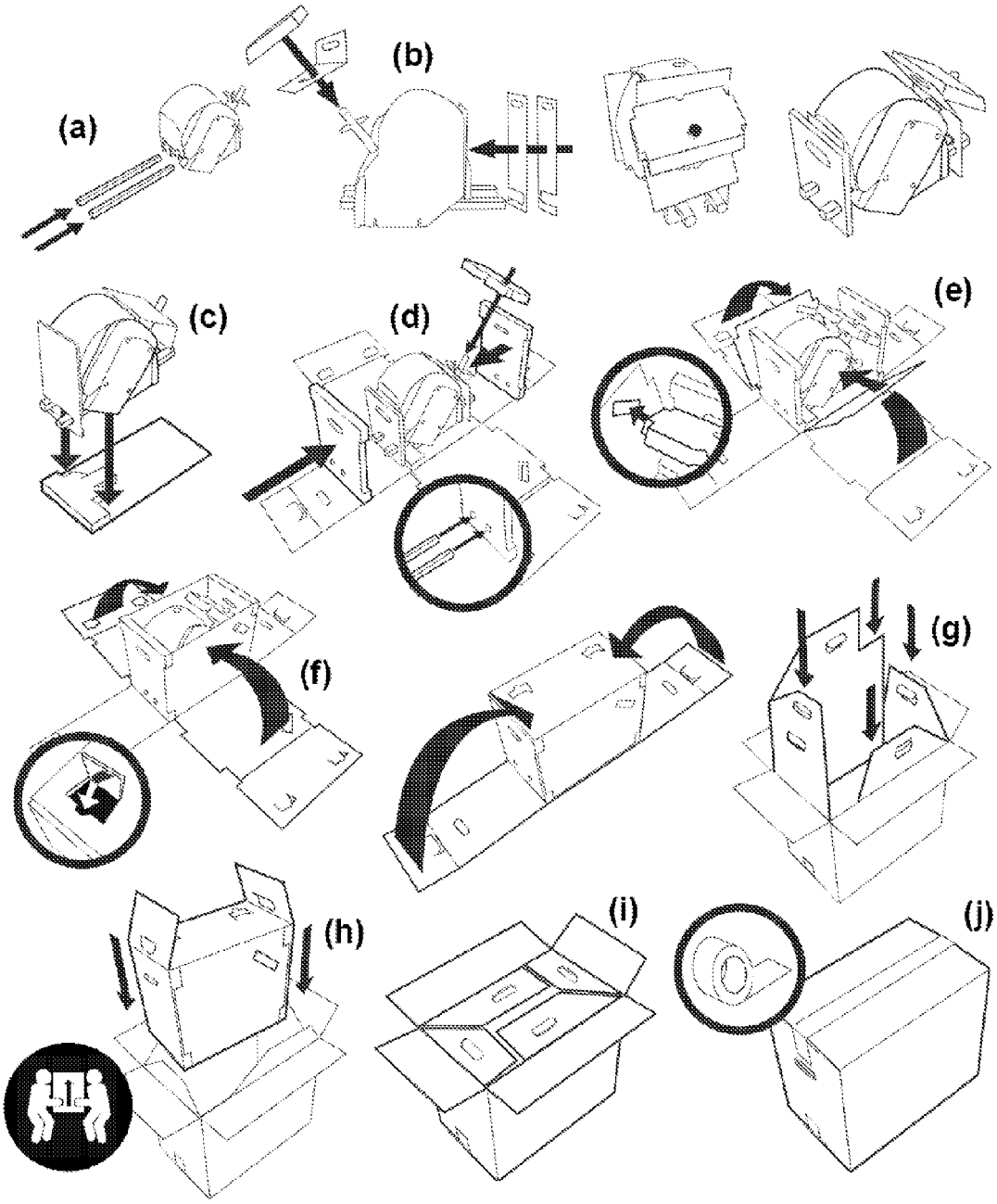
FIG. 5 shows steps in a process for packing an item in a shipping box.

FIGS. 5*a*-5*b* shows steps in a process for packing an item into a shipping box. Various components, such as those described above, may be used in the process. At step (a), an object to be protected and shipped is mounted onto a pair of rails to which it will be held tight during shipping. Carrying handles for safe transport of the item are then placed around the item as in step (b). The object is then placed on a base, step (c), and the ends of the rails are inserted into holding blocks that are part of protective panels on opposed sides of the object. For example, the blocks may be slid over the rails until they reach a predetermined position (which may be controlled, for example, by providing, as the outermost sheet of the panels, a sheet without any holes for the rails, so that the rails are stopped from passing all the way through the panels). Another block is placed on a seat extension at the top of the object—here, a stairlift drive unit—to be protected, step (d).

At step (e), the sides of the panels for an enclosure are folded upward. The upper block has extensions in the form of tabs that are inserted into openings in the sides (as shown by a zoomed in circle near step (e)). The other side panels may be folded upward, as in step (f), and top panels may then be folded over and connected (such as by bending a tab from one panel through a hole from another) to form a relatively solid enclosure for the item.

At step (g) side panels are slid into a shipping box, and the enclosure is then dropped in, step (h). Flaps may be provided that extend upwards above the sides of the box so that a user may grasp handles on the enclosure all the way into the box. The flaps may then be folded down, and the flaps on the side panels may also be folded down. The top flaps of the box may then, in step (i), be folded down and secured in a conventional method, step (j).

Figure 6:
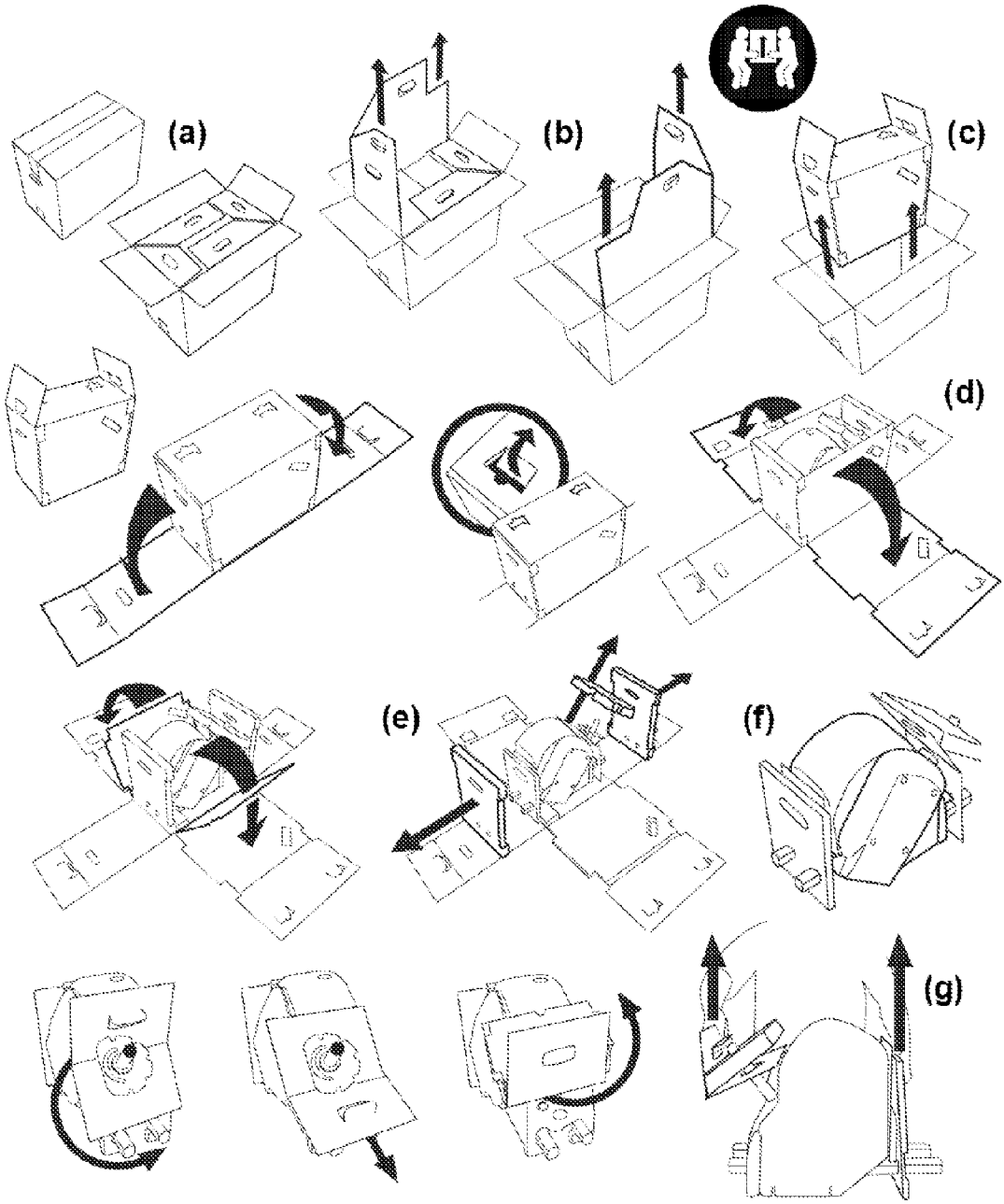
FIG. 6 shows steps in a process for unpacking an item in a shipping box.

FIGS. 6*a*-6*b* show steps in a process for unpacking an item in a shipping box. In general, the unpacking steps occur in the opposite order, as do the packing steps that were just described. At step (a) the user opens the outer box, and at step (b) removes the two panels. At step (c), the user removes the enclosure from the box, and at step (d), the user releases the tabs holding the sides in place and folds the panels flat against the floor. At step (e) the user removes the blocks, and at step (f) the user positions the carrying handles into a correct position for carriage, then at step (g) the user uses the carrying handles to position the stairlift onto rails, and the transport rails can then be removed from the stairlift device.

The particular steps and graphics shown in FIGS. 5*a*, 5*b*, 6*a*, and 6*b* may be provided on instruction sheets that are given to users of the system, so as to better guide them in packing and/or unpacking items. Either or both of the packing and unpacking instructions may be provided; for example, recipients of a product (e.g., buyers) may receive both sets of instructions so that they can unpack the object, and in case they need to re-pack the object to return it or otherwise ship it after unpacking it.

As can be seen, the systems and methods described here can provide a convenient packing system that protects products that have areas that can be solidly mounted, and other areas that are not quite as strong. For example, the system may be implemented using relatively inexpensive and plentiful materials such as corrugated board. In addition, the materials are familiar to users. Moreover, the particular structures that make up the enclosure may still be fit into a standard shipping box, and thus would not require any special box-making efforts or shipping efforts. Moreover, the processes described are relatively simply, and can be completed quickly, thereby saving shippers employee time and saving recipients time and frustration.

A number of embodiments of the invention have been described. Nevertheless, it will be understood that various modifications may be made without departing from the spirit and scope of the invention. For example, although the object to be protected is shown as having only empty space around it, the object could have cushioning structures, and the more solid mounting of the object may act to substantially lessen any forces that would otherwise be transmitted to such structure. Also, various forms of the exemplary structures may be employed, and the steps of the processes may be performed in other orders, and steps may be added or removed as appropriate. Accordingly, other embodiments are within the scope of the following claims.

What is claimed is:

1. A shipping box system, comprising:

a plurality of walls constructed from cardboard and defining a volume substantially in the form of a cuboid;

a rigid base near a first wall of the plurality of walls adapted to resist motion relative to the first wall;

a rigid mount attached to the rigid base and adapted to connect with a shipped item to be placed in the volume, wherein the rigid mount extends from a portion of the rigid base near a first end of the first wall to a portion of the rigid base near a second end of the first wall that is opposed to the first end of the first wall, and a shipped item rigidly attached to the rigid mount from a first side of the shipped item with mounting structures that are part of the shipped item attaching the shipped item to the rigid mount, wherein a side of the shipped item, which is opposed to the first side, is not attached to the shipping box system so that it extends in free space in the cuboid volume, the plurality of walls are configured to create a free space around the shipped item so as to prevent damaging contact with a substantial portion of the shipped item, and portions of the shipped item that do not contact the rigid mount are out of contact with any portion of the shipping box system, so as to prevent injury to the portions of the shipped item caused by distortion of the shipping box system during shipping.

2. The system of claim 1, wherein the plurality of walls are formed from a single sheet of folded corrugated board.

3. The system of claim 1, wherein the rigid mount is the only structure inside the volume that is adapted to connect to the shipped item.

4. The system of claim 3, wherein the rigid base comprises one or more mounting blocks positioned near opposed edges of the first wall and the rigid mount comprising one or more rails attached to the one or more mounting blocks.

5. The system of claim 4, wherein the rigid mount comprises a pair of pipes mounted between a pair of mounting blocks.

6. The system of claim 5, wherein the mounting blocks comprise a plurality of sheets of corrugated board adhered in stacks having multiple layers with opposed lines of corrugation.

7. The system of claim 1, wherein the rigid base comprises a pair of mounting blocks positioned against opposed inner walls of the plurality of walls, and wherein each mounting block of the pair of mounting blocks is made up of a plurality of stacked and joined sheets of cardboard, wherein each mounting block is substantially the same width of the inner wall against which it is positioned so that the mounting block is foxed from movement inside the volume.

8. The system of claim 1, further comprising reinforcing panels at opposed walls of the volume that provide torsional rigidity to prevent distortion of the volume.

9. The system of claim 8, wherein the reinforcing panels comprise a plurality of sheets of corrugated board adhered in stacks having multiple layers with opposed lines of corrugation.

10. The system of claim 8, wherein the rigid base comprises one or more mounting blocks positioned near opposed edges of the first wall.

11. The system of claim 1, further comprising a substantially closed enclosure inside the volume and around the item to be placed in the volume.

12. The system of claim 1, further comprising one or more removable panels between the plurality of walls and a structure holding the item, wherein removal of the panels results in reduced friction between the plurality of walls and the structure by opening an open space between the plurality of walls and the structure, thereby permitting easier removal of the structure and the item from the volume.

13. A shipping box system, comprising:

an outer enclosure in the form of a shipping box, and defining a plurality of inner walls, including four walls that form a four-sided closed loop, wherein each adjacent wall forms essentially a right angle with the next adjacent wall;

an inner enclosure for holding an item to be shipped, and having a plurality of surfaces parallel with, and spaced slightly apart from, the plurality of inner walls of the shipping box; and one or more slide-out panels held between the plurality of surfaces on the inner enclosure and the plurality of inner walls on the shipping box, wherein the slide-out panels are arranged to be removed from the outer enclosure before the inner enclosure is removed from the outer enclosure, and the slide-out panels are in contact with at least two adjacent walls of the four walls that form the four-sided closed loop and are located between the at least two adjacent walls of the four walls and two corresponding adjacent outer walls of the inner enclosure, so that removal of the slide-out panels creates open space between the two adjacent walls of the four walls and the adjacent walls of the inner enclosure so that the inner enclosure can slide out of the outer enclosure without substantial frictional forces between the inner enclosure and the outer enclosure.

14. The system of claim 13, wherein the outer enclosure defines a cuboid, and the inner enclosure also defines a cuboid.

15. The system of claim 13, wherein the slide-out panels each include at least one tab that extends beyond a first edge of the inner enclosure and that is arranged to fold downward at a right angle to a body of the respective slide-out panel over a second edge of the inner enclosure.

* * * * *